United States Patent [19]

Baron

[11] 4,123,087

[45] Oct. 31, 1978

[54] TYPING GUIDE

[76] Inventor: Alvin J. Baron, 718 Sherwood St., North Woodmere, N.Y. 11581

[21] Appl. No.: 841,105

[22] Filed: Oct. 11, 1977

[51] Int. Cl.[2] ..... B42D 15/00

[52] U.S. Cl. ..... 283/1 R; 400/622

[58] Field of Search ..... 283/1 R; 400/622, 707.5

[56] References Cited

U.S. PATENT DOCUMENTS 898,916 9/1908 Ohashi ..... 283/1 R

*Primary Examiner*—Willie G. Abercrombie

*Attorney, Agent, or Firm*—Samson Helfgott

[57] ABSTRACT

A typing guide formed of a single backing sheet having footnote indicating indicia printed on the front surface of the backing sheet and footnote samples printed on the back surface of the backing sheet. The footnote indicating indicia provide a dual method of determining footnote spacing. The indicia include a column of numerals printed adjacent one side of the backing sheet and progressively increasing down the column. The numerals are spaced apart from each other a distance equal to the line spacing of a typewriter platen. These numerals are used for accurate determination of footnote spacing. Additionally, several marks are printed in vertical sequence adjacent to the bottom portion of the column of numerals with the marks corresponding to preselected ones of the numerals. The marks are numerically identified by a progressively increasing sequence of numbers commencing from the lowermost mark. These marks are used for a second and more simplified method of footnote spacing. The footnote samples on the back surface are printed in upside down orientation with respect to the front surface, so that as footnotes are being typed, the backing sheet can be bent forward with the footnote samples appearing in upright orientation so that the proper footnote sample can be selected.

19 Claims, 3 Drawing Figures

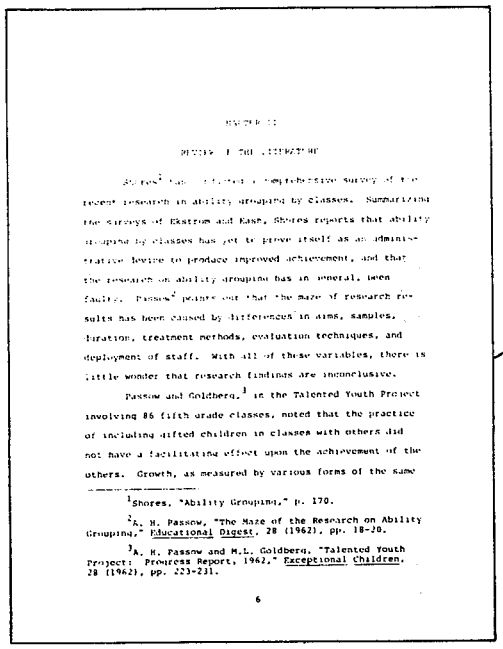

[illegible]

[illegible] recent research in ability grouping by classes. Summarizing the surveys of Ekstrom and Kash, Shores reports that ability grouping by classes has yet to prove itself as an administrative device to produce improved achievement, and that the research on ability grouping has in general been faulty. Passow[2] points out that the maze of research results has been caused by differences in aims, samples, duration, treatment methods, evaluation techniques, and deployment of staff. With all of these variables, there is little wonder that research findings are inconclusive.

Passow and Goldberg,[3] in the Talented Youth Project involving 86 fifth grade classes, noted that the practice of including gifted children in classes with others did not have a facilitating effect upon the achievement of the others. Growth, as measured by various forms of the same

[1]Shores, "Ability Grouping," p. 170.

[2]A. H. Passow, "The Maze of the Research on Ability Grouping," Educational Digest, 28 (1962), pp. 18-20.

[3]A. H. Passow and M.L. Goldberg, "Talented Youth Project: Progress Report, 1962," Exceptional Children, 28 (1962), pp. 223-231.

6

50

SAMPLE NEW CHAPTER PAGE

52

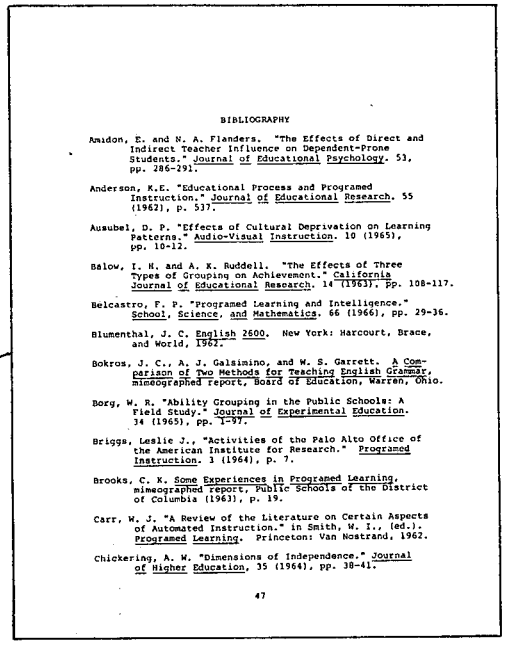

BIBLIOGRAPHY

Amidon, E. and N. A. Flanders. "The Effects of Direct and Indirect Teacher Influence on Dependent-Prone Students." Journal of Educational Psychology. 51, pp. 286-291.

Anderson, K.E. "Educational Process and Programed Instruction." Journal of Educational Research. 55 (1962), p. 537.

Ausubel, D. P. "Effects of Cultural Deprivation on Learning Patterns." Audio-Visual Instruction. 10 (1965), pp. 10-12.

Balow, I. H. and A. K. Ruddell. "The Effects of Three Types of Grouping on Achievement." California Journal of Educational Research. 14 (1963), pp. 108-117.

Belcastro, F. P. "Programed Learning and Intelligence." School, Science, and Mathematics. 66 (1966), pp. 29-36.

Blumenthal, J. C. English 2600. New York: Harcourt, Brace, and World, 1962.

Bokros, J. C., A. J. Galsimino, and W. S. Garrett. A Comparison of Two Methods for Teaching English Grammar, mimeographed report, Board of Education, Warren, Ohio.

Borg, W. R. "Ability Grouping in the Public Schools: A Field Study." Journal of Experimental Education. 34 (1965), pp. 1-97.

Briggs, Leslie J., "Activities of the Palo Alto Office of the American Institute for Research." Programed Instruction. 3 (1964), p. 7.

Brooks, C. K. Some Experiences in Programed Learning, mimeographed report, Public Schools of the District of Columbia (1963), p. 19.

Carr, W. J. "A Review of the Literature on Certain Aspects of Automated Instruction." in Smith, W. I., (ed.). Programed Learning. Princeton: Van Nostrand, 1962.

Chickering, A. W. "Dimensions of Independence." Journal of Higher Education, 35 (1964), pp. 38-41.

47

SAMPLE BIBLIOGRAPHY PAGE

BOOKS—ONE AUTHOR

[1]Herbert S. Gershman, The Surrealist Revolution in France (Ann Arbor: University of Michigan Press, 1969), p. 47.

BOOKS—TWO AUTHORS

[2]T.K. Derry and Trevor I. Williams, A Short History of Technology (Oxford: Oxford University Press, 1961), p. 47.

BOOKS—THREE AUTHORS

[3]Bernard C. Raffer, Richard Friedman, and Robert Baron, New York In Crisis (New York: Harper and Row, 1971), pp. 93-97.

BOOKS—MORE THAN THREE AUTHORS

[4]Adam Rogers, Jr., et.al., Handbook of Clinical Resources (New York: McGraw Hill, 1975), p. 47.

BOOK: EDITOR INSTEAD OF AUTHOR

[4]Jacquetta Hawkes, ed., The World Of The Past (New York: Alfred A. Knopf, 1963), p. 171.

ARTICLE IN JOURNAL

[1]R. Brogdon, "Religious Freedom and School Holidays," Phi Delta Kappan, 58 (May 1977), 700.

SIGNED ARTICLE IN MAGAZINE

[2]Jack W. Germond, "Congress and Carter: Who's in Charge?" New York Times Magazine, January 30, 1977. p. 22.

UNSIGNED ARTICLE IN MAGAZINE

[2]"Southern Africa: Trade Feeds on Independence," Business Week, February 14, 1977, pp. 66-67.

SIGNED ENCYCLOPEDIA ARTICLE

[2]Austin Woolrych, "Oliver Cromwell," Encyclopedia Americana, 1977, VIII, 239.

UNSIGNED ENCYCLOPEDIA ARTICLE

[4]"Alexander Pope," Encyclopedia Britannica. 15th ed., XIV, 796.

NEWSPAPER ARTICLE WITH BY LINE

[1]Gene I. Maeroff, "Circumscribing School Aid," New York Times, July 9, 1977, p. 7.

NEWSPAPER ARTICLE WITHOUT BY LINE

[1]"Pilot Calls Unrest Widespread in China," New York Times, July 9, 1977, p. 1.

GOVERNMENT PUBLICATIONS

[1]U.S. Department of State, The Cambodian Situation 1971-72 (Washington, D.C.: Government Printing Office, 1974), p. 227.

FOOTNOTE SAMPLES

46

BOOKS—ONE AUTHOR

Gershman, Herbert S. The Surrealist Revolution in France. Ann Arbor: University of Michigan Press, 1969.

BOOKS—TWO AUTHORS

Derry, T.K., and Williams, Trevor I. A Short History of Technology. Oxford: Oxford University Press, 1961.

BOOKS—THREE AUTHORS

Raffer, Bernard C.; Friedman, Richard; and Baron, Robert. New York In Crisis. New York: Harper & Row, 1971.

BOOKS—MORE THAN THREE AUTHORS

Rogers, Adam, Jr.; Smith, Otis; Riff, Charles and Burns, Albert. Handbook of Clinical Resources. New York: McGraw Hill, 1975.

BOOK: EDITOR INSTEAD OF AUTHOR

Hawkes, Jacquetta, ed. The World Of Art. New York: Alfred A. Knopf, 1963.

ARTICLE IN JOURNAL

Brogdan, R. "Religious Freedom and School Holidays." Phi Delta Kappan. 58 (May 1977), 700.

SIGNED ARTICLE IN MAGAZINE

Germond, Jack W. "Congress and Carter: Who's in Charge?" New York Times Magazine. January 30, 1977 p. 22.

UNSIGNED ARTICLE IN MAGAZINE

"Southern Africa: Trade Feeds on Independence." Business Week. February 14, 1977. pp. 66-67.

SIGNED ENCYCLOPEDIA ARTICLE

Woolrych, Austin. "Oliver Cromwell." Encyclopedia Americana. 1977. Vol. VIII.

UNSIGNED ENCYCLOPEDIA ARTICLE

"Alexander Pope." Encyclopedia Britannica. 15 ed. Vol. XIV.

NEWSPAPER ARTICLE WITH BY LINE

Maeroff, Gene I. "Circumscribing School Aid." New York Times. July 9, 1977.

NEWSPAPER ARTICLE WITHOUT BY LINE

New York Times. "Pilot Calls Unrest Widespread in China." July 9, 1977.

GOVERNMENT PUBLICATIONS

U.S. Department of State. The Cambodian Situation 1971-72. Washington, D.C.: Government Printing Office, 1974.

BIBLIOGRAPHY SAMPLES

48

FIG. 3

TYPING GUIDE

BACKGROUND OF THE INVENTION

1. Field of the Invention

This invention relates to a typing guide and more particularly to a typewriter backing sheet especially useful for the typing of research papers requiring footnotes.

2. Description of the Prior Art

In typing various textural materials, separate unique formats have been designed for particular types of these materials. For example, in typing letters, there are special formats available for appropriate placing of the address, date, reference, and other parts of the letters. Similarly, special formats are recommended for memorandum, reports, etc. However, one of the most complex materials to type are research papers, dissertations, theses, term papers, and similar academic material.

Most academic institutions follow similar formats concerning appropriate margins, pagination, headings, and other formalities concerning the layout of the reports. The procedures for research paper typing becomes even more complex when footnotes and a bibliography must be included.

It is generally accepted that footnotes should appropriately appear on the bottom of the page on which the footnote reference is indicated. This necessitates leaving a portion at the bottom of the page beneath the textural material to accommodate the typing of the footnotes. However, since a number of footnotes may be required on each page, it becomes most difficult to accurately space the page to accommodate the footnotes needed and at the same time maintain the required margin at the bottom of the page.

Research papers, and the like, are further complicated by the extremely complex standards accepted for appropriate footnote formats. Depending upon the reference work, the format and style of the footnote differs. For example, a footnote referencing a book is different from one referencing an article. Even book footnotes vary with the number of authors of the book. Similarly, when referencing an article, the footnote will differ depending upon whether it comes from a journal, a signed article in a magazine, an unsigned article in a magazine, a signed encyclopedia article, etc. Each of the footnotes requires different punctuation, spacing, abbreviation, etc.

To complicate matters even further, most research papers, and the like, require bibliographies at the end of the manuscript. While the same reference work referred to in a footnote will also be included in the bibliography, the format and punctuation listing the reference in the bibliography will differ from its corresponding listing in the footnote.

As a result, when typing research papers, and the like, it becomes necessary to use various guide books having instructions for appropriate spacing and formatting of the manuscript as well as containing samples for both manuscript text, footnotes, bibliography, tables, etc. The typical guide books are generally large and require considerable amount of time to find the appropriate sample or instruction for a particular footnote or bibliography. Furthermore, although samples and instructions may be given for appropriate margins, spacing, and pagination, it is time consuming to transfer this information from the guidebook to actual practice on the typewriter.

In the past, typing guides have been available as simple aides to regular manuscript typing of letters and the like. For example, U.S. Pat. No. 898,916 describes a typewriter backing sheet which includes a line indicator along each edge of the backing sheet to permit easy indentification of the typing line. Other types of guides have also been available for organization of copy on a page such as U.S. Pat. No. 1,151,782 which includes a grid like arrangement on a writing sheet to facilitate the location of copy on the sheet. Other such simple backing sheets and organization sheets have been available. However, none of these accommodated the special needs and requirements of the research paper.

Recently, there has been available an academic typing guide published by Jemco Academic Supplies, Tulsa, Okla. This typing guide included two sheets secured together to form a pocket in which a sheet of typing paper can be inserted therebetween. An opening is formed on one of the sheets to permit access to type onto the typing paper and defines the limits of the typing space. A column of numbers is provided on the front of the top sheet which numbers commence at both top and bottom of the sheets and continue until the center of the sheet. Certain of the numbers on the bottom are set aside for footnote indications.

While this academic typing guide has provided some solution to the problem of research paper typing, it has not completely satisfied the need. For example, it is still necessary to utilize guide books to provide footnote and bibliography samples when typing the footnotes. Furthermore, although the outer margins are defined, there is no provision for heading lines, pagination, and other format requirements for research papers and the like. Additionally, the aforementioned academic typing guide is extremely difficult to utilize in practice. The typing paper is sandwiched between the front and rear sheets with only a portion of the typing paper available. Although the margins are defined, should it become necessary to over run a margin by even one letter, it is impossible to type that letter since the overlying sheet prevents access to the typing paper in the area unexposed by the opening. Additionally, when rolling the typing paper, contained within the typing guide, into and out of the typewriter, the overlying front sheet has a tendency to catch under the ribbon guide of the typewriter, the holding plate of the typewriter, and other parts of the typewriter mechanism. This can then rip the typing guide itself as well as tear the paper.

A further problem with this available academic typing guide is that the footnote indicator included on the underlying front sheet, only provides an estimation of the space needed for the footnotes. The estimation is based upon an average number of lines in a footnote. However, should a number of footnotes have more or less than average, utilizing the footnote indicator provided will give erroneous margins.

SUMMARY OF THE INVENTION

Accordingly, it is an object of the present invention to provide a typing guide which avoids the aforementioned problems of prior art devices.

A further object of the present invention is to provide a typing guide especially useful for research paper typing, and the like.

Still a further object of the present invention is to provide a typing guide which facilitates the location and typing of footnotes.

Yet another object of the present invention is to provide a typing guide which provides both an estimate as well as an accurate indication of the amount of room needed for positioning of footnotes at the bottom of a page of manuscript.

An object of the invention is to provide better impressions even with worn platens, and to reduce typing noise and protect platens.

Another object of the present invention is to provide a typing guide which contains footnote samples on the guide and permits use of the guide both as a backing sheet and as a source of the footnote samples for guidelines in typing the footnotes.

Still another object of the present invention is to provide a typing guide which includes both footnote samples and bibliography samples and utilizes identical references for both such samples for comparison style and format.

Another object of the present invention is to provide a typing guide for research paper typing which includes a footnote indicator as well as typing guides such as margins, heading lines, a center line, and pagination guides.

A further object of the present invention is to provide a method of typing footnotes using a research paper typing guide having footnote indicating indicia printed on one side and footnote samples printed on the other side.

Still another object of the present invention is to provide a method of forming a typing guide for typing of texts and footnotes, typically for research papers and the like.

Briefly, the invention provides a typing guide formed of a single typewriter back sheet which is adapted to underlie a sheet of typing paper when inserted in a typewriter. The backing sheet includes a front and back surface as well as top, bottom, and side edges. Two different types of footnote indicators are printed directly on the front surface for providing an indication of the space needed in order to type a required number of footnotes near the bottom portion of a sheet of typing paper.

The footnote indicator comprises a column of numerals arranged adjacent one side edge of the backing sheet. The numerals progressively increase down the column from proximate the upper edge of the backing sheet to proximate the lower edge. The numerals are spaced apart from each other a distance equal to the line spacing of a typewriter platen.

Additionally, several additional footnote indicator marks are arranged in vertical sequence from proximate the lower edge of the backing sheet. The marks respectively correspond to preselected numerals in the column. The marks are numerically identified by a progressively increasing sequence of numbers from the lowermost mark to the upper most mark.

Footnote samples are printed on the back surface of the backing sheet. The footnote samples are printed upside down with respect to the orientation of the front surface of the backing sheet. The footnote samples are located at least adjacent to the top edge of the backing sheet. In this manner, when footnotes are being typed near the bottom portion of the typing paper, the backing sheet can be bent forward with the footnote samples then appearing in proper orientation on the back surface.

The footnote samples can be placed on one side of a vertically divided portion of the back surface. The other side can include the bibliography samples oriented in the same direction as the footnote samples By using the identical reference work for both the footnote sample and the adjacent bibliography sample, an easy comparison of the differences between the two formats can be noted.

The invention also contemplates use of the aforedescribed typing guide in typing of footnotes. The sheet of typing paper is placed over the backing sheet and inserted into the typewriter. In using the sequence of marks, an easy method can be obtained for determining the amount of space needed for typing the footnotes. In this method, the desired text material is typed on the paper sequentially identifying the footnote numbers included in the text. The typing of the text material is terminated upon reaching the mark having the same identifying nunber as the last footnote types on the text. The footnotes are then typed on the remainder of the page.

When using the column of numerals, a more accurate method can be obtained for typing the footnotes. In this method the number of lines required to type the footnotes are counted as the text material is typed. Additional lines are then added for separation. Through a simple arithmetic process the lines for the final line of text and the footnotes are then determined, resulting in an accurately placed bottom page margin.

The invention also contemplates a method of forming the aforementioned typing guide by selecting a flexible backing sheet and printing the appropriate footnote indicators on the front surface while printing footnote samples on the back surface in upside down orientation with the front surface. Additional material can also be printed in accordance with the aforedescribed typing guide.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 3 shows the back surface of the typing guide.

In the various figures of the drawing, like reference characters designate like parts.

DESCRIPTION OF THE PREFERRED EMBODIMENTS

Figure 1:
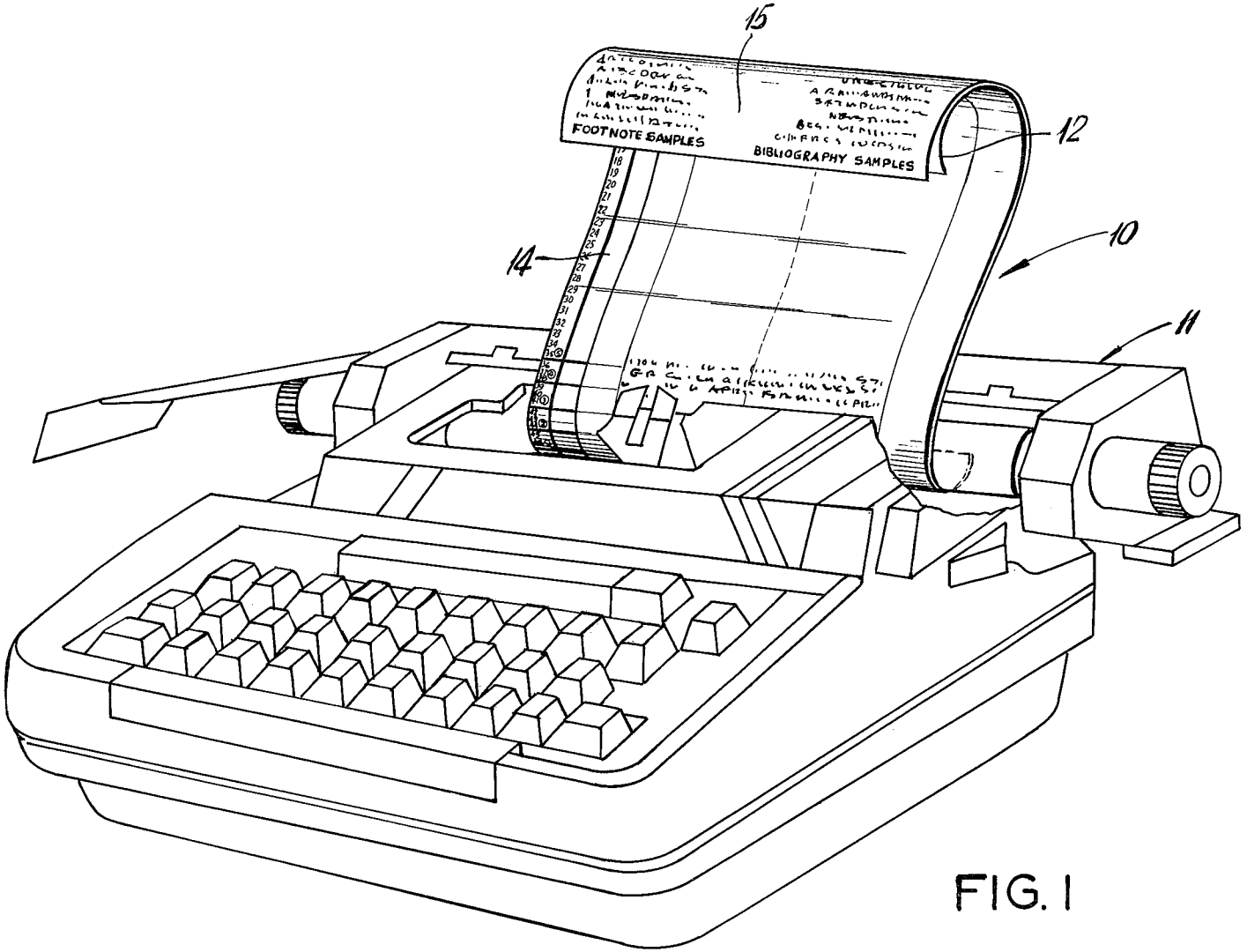
FIG. 1 is a perspective view showing the typing guide and typing paper inserted in a typewriter and being used for the typing of footnotes.

Referring now to FIG. 1, the typing guide of the present invention is shown generally at 10 as it underlies a sheet of typing paper 12 and is positioned in a typewriter 11 in a usual manner rolled around the typewriter platen. The typing guide has a front and back surface. The front surface 14 faces the back of the typing paper 12 and is inserted into the typewriter so that the indicia printed on the front surface is readable through the translucent typing paper.

Figure 2:
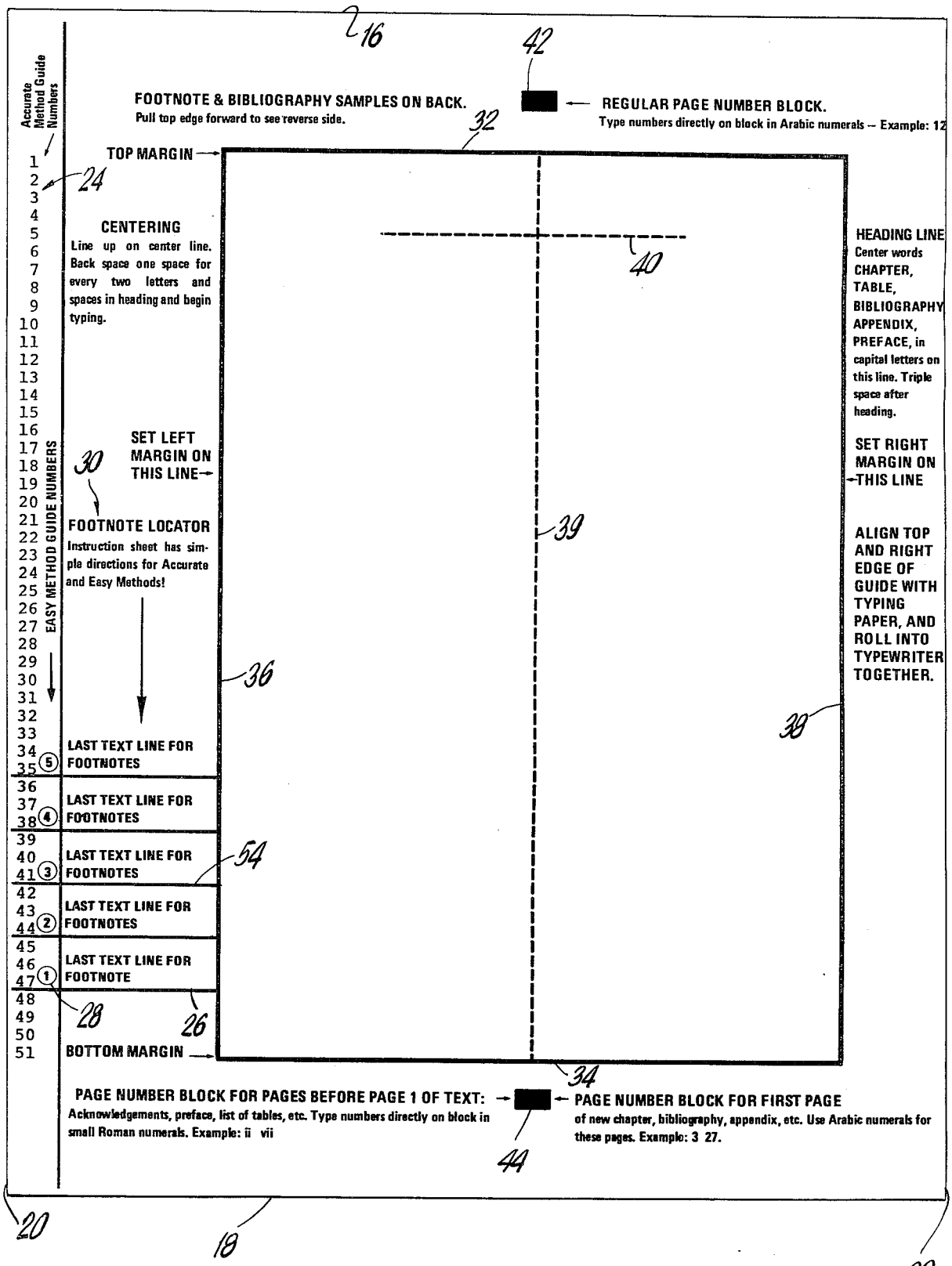
FIG. 2 shows the front surface of the typing guide.

Referring now to FIG. 2, there is shown the front face of the backing sheet. The backing sheet includes a top edge 16, a bottom edge 18, as well as left edge 20 and right edge 22. Positioned adjacent the left edge 20 are a column of numerals 24 which commence adjacent the top edge 16 of the backing sheet and progressively increase in number going toward the bottom edge 18. The spacing between the numbers approximately equals the distance of the line spacing of a typewriter platen. The numbers commence with 1 and continue until the last line which is identified as number 51.

Additionally, there are provided a series of marks 26, shown as horizontal lines extending across the column of numbers 24 at preselected ones of the numbers. A series of these marks commence from adjacent the lower edge of the backing sheet and continue at spaced intervals vertically along the column of numerals. Specifically, the lower most line 26 follows the numeral 47, the next line follows the numeral 44, etc. Each of these marks are numerically identified by progressively increasing sequence of numbers 28 which commence from the lower most mark. For example, the lowest mark is identified by the numeral 1. The next mark proceedingly upwardly has the numeral 2 and so on until the upper most mark has the indentification number 5.

The row of numerals is used to identify a particular typing line and is also used to provide an accurate method of locating footnotes on the page. The series of marks 26 are utilized to provide an easy method for locating footnotes and is accordingly identified by the indicia 30 as a "footnote locator".

Also placed on the front surface are additional guides for proper placing and formatting of the text on the page. A series of margin lines including the top margin 32, the bottom margin 34, and side margins 36 and 38 define a rectangular area in which the manuscript can be typed. A dotted center line 39 is provided within this area for centering of headings and other material. A dotted heading line 40 is also provided within the rectangular typing area to permit the placing of various titles and other headings. Additionally, there are provided two page number blocks 42, 44, for proper placement of the pagination. As is explained by means of the printed indicia on the front surface, the upper page block 42 is generally used for page numbering with the exception of the first pages of chapters, appendices, etc., when the lower page block 44 is used. Both these page blocks are outside of the rectangular typing area.

Additional typing information is also printed directly on the front surface of the typing guide to facilitate appropriate setting of the information on the page and avoid the necessity for continuous referral to guide books and format samples.

Referring now to FIG. 3, there is shown the information printed on the back surface of the backing sheet. It should first be noted, as can best be seen in FIG. 1, that the information printed on the back surface is upside down with respect to the orientation of the front surface. Thus, the lower part of the back surface is adjacent to the top edge of the front of the backing sheet. As will be explained hereinafter, this facilitates bending forward of the backing sheet to easily read the information contained on the back surface in an upright orientation.

The bottom portion of the back surface is vertically divided to form two columns. On the left column are printed several footnote samples 46. On the right hand column there are provided a series of bibliography samples 48. As is well known, the particular style of a footnote depends upon the reference work. For example, as shown in the first of the footnote samples, a book with one author has a particular style which differs from the style of a book with two authors. Accordingly, various types of footnote styles are included which generally cover most of the reference work typically utilized in a research paper. It is also known that the same reference work when listed in a bibliography has a different format. Therefore, there are also provided a series of different types of reference books in the bibliography samples. It should be noted, that the same difference work is shown with a footnote style on one side and the same identical reference work is shown in bibliography style on the other side. This permits the user to easily compare the distinctions between these two styles and properly provide the information in his manuscript.

On the top of the back surface shown in FIG. 3, additional information is provided. In the left column there is shown at 50 a sample of a new chapter page. This gives a general format for placing chapter headings and titles, as well as the positioning of footnotes at the bottom of the page. In the right column at 52 is shown a sample bibliography page which shows how to arrange the appropriate spacing for placing a bibliography at the end of the text.

In using the typing guide typical typing paper is used without carbon paper. For example, twenty pound bond, $8\frac{1}{2} \times 11$ typing paper is adequate. The typing paper is aligned with the top and right edges of the typing guide with the front surface shown in FIG. 2 facing towards the typing paper. The typing guide and paper are then rolled into the typewriter with the edges adjusted if necessary. The width of the typing guide is made greater than the width of the typing paper so that at least the column of numbers 24 as well as the series of identifying numbers 28 are exposed beyond the typing paper on the left.

The left typewriter margin is then set so that the first letter to be typed is just inside of the left vertical guide margin 36. It should be noted, that the information printed on the typing guide is visible through the typing paper. The right typewriter margin is then set so that the last letter to be typed is just inside the right vertical guide margin. While these margins are then set, nevertheless, should it become absolutely necessary, it is possible to extend a letter or two past the margins as needed. The paper is then rolled down until the first line of type is just below the top horizontal guide margin 32. This will then correspond to line 1 as indicated on the row of numerals provided at the left.

Two methods can be utilized to locate the footnotes on the page. The first method uses the footnote locater 30 comprising the series of marks 26 with the identifying numeral 28. As the text is typed, the footnote numbers are inserted in their proper place along the text material. As the lower half of the page is being typed, the series of numbers 28 of the footnote locater 30 are examined to find the same number as the last footnote number typed in the text. For example, if there are three footnotes in the text material, typing is stopped on or as close as possible as the number three which identifies the mark 54.

A single space is then left after the last line of text and an unbroken separation line is typed, typically 20 spaces in length from the left hand margin. A double space is then provided and the first footnote is then begun. The footnotes are then single spaced providing a double space between each footnote.

The footnote indicator 30 has been set for typical two line footnotes. Even though some may contain a single line while others may extend onto three lines, these average out so that a fairly accurate indication is provided. All typing should stop as close to the bottom margin line 34 as possible.

It is best to avoid a footnote number in the last line of the text material. If there are footnotes which are longer than three lines, or if several of the footnotes only contain one line, it may be preferable to use the more accurate method of locating footnotes as will be described.

In order to have a very accurate method of locating footnotes, typing is again begun on line one as previously indicated. When the first footnote number is reached in the text, an estimate must be made of the total number of lines needed to type the complete first footnote. Then, an additional two lines are added for separation between the text and the footnotes. This number is then subtracted from the last numeral in the row, which is numeral 51. The remainder is the line number of the last line of text where the typist should stop.

For example, if it is estimated that the first footnote will occupy one line, two additional lines are added for separation from the text to provide a total of three lines. This is then subtracted from numeral 51 to obtain the number 48 which is the last line of text to be typed.

If there are more footnotes on the page, as the second footnotes is reached, again an estimation is made of the number of lines needed for the second footnote and this time one additional line is added for separation between the footnotes.

For example, when the second footnote is reached, if it is estimated that it will require two lines for the footnote, the two lines are added to a single additional line separating the first and second footnote to provide a total of three lines. This is substracted from the previous count of 48 to now obtain a new last line of text equal to 45.

This process is continued for each remaining footnote on the page. This will then determine that the last footnote entry will end on the 51st line of the page and provide the desired bottom margin.

When footnotes are being typed they will be near the bottom of the typing paper. As a result, most of the top portion of the typing guide will extend upwardly from the front portion of the typewriter platen, as shown in FIG. 1. At that time, it is possible to bend the typing guide forward so that the back surface 16 is facing toward the front. The footnote samples will then be available and will appear right side up for easy reading. The appropriate footnote sample can be selected from the samples provided on the proper style for the footnote determined.

The typing guide is formed of a cushioning backing sheet which is sturdy enough to support the typing paper and at the same time flexible enough to roll in the typewriter platen and also bend forward for viewing the footnote samples. Just as the footnote samples can be viewed by turning the typing guide forward, when typing bibliographies the typing guide can also be turned forward to obtain the appropriate sample of the bibliography style.

It should be noted, that since only a single backing sheet is provided, there is no problem in rolling the paper and backing sheet up and down in the typewriter. Should a particular footnote sample not be readily available the typewriter can be rolled until the proper footnote sample, or bibliography sample, is visible and then rolled back to return to the typing position needed.

There has been disclosed heretofore the best embodiment of the invention presently contemplated. However, it is to be understood that various changes and modifications may be made thereto without departing from the spirit of the invention.

I claim:

1. A typing guide, comprising:

a single typewriter backing sheet adapted to underlie a sheet of typing paper when inserted in a typewriter, said backing sheet having front and back surfaces, and top, bottom and side edges, and footnote indicator means printed directly on said front surface for providing an indication of the space needed to type the required number of footnotes near the bottom portion of the sheet of typing paper.

2. A typing guide as in claim 1 and further comprising footnote samples printed in said back surface, said footnote samples being printed upside down with respect to the orientation of the front surface, and located at least adjacent the top edge of the back sheet, whereby when footnotes are being typed near the bottom portion of the typing paper, the backing sheet can be bent forward with the footnote samples appearing in proper orientation at the lower portion of the back surface.

3. A typing guide as in claim 1 and wherein said backing sheet is wider than the typing paper, and said footnote indicator means is arranged adjacent one side edge of said backing sheet, whereby the footnote indicator means extends beyond the typing paper.

4. A typing guide as in claim 3 and wherein said footnote indicator means comprises several marks arranged in a vertical sequence from proximate the lower edge of the backing sheet, said marks being numerically identified by a progressively increasing sequence of numbers from the lower most mark to the uppermost mark.

5. A typing guide as in claim 4 and further comprising a column of numerals arranged adjacent said one side edge of said backing sheet, said numerals progressively increasing down the column from proximate the upper edge to proximate the lower edge, and being respectively spaced apart from each other a distance equal to the line spacing of a typewriter platen, and wherein said marks respectively correspond to preselected numerals.

6. A typing guide as in claim 5 and further comprising guide means printed on said front surface and visible through the typing paper, said guide means comprising top, bottom, and side margin lines, a heading line, a vertical center line, and page number blocks.

7. A typing guide as in claim 6 and wherein said margin lines form a rectangular typing area, said heading line is within said typing area and said page blocks are outside of said typing area, a first of said page blocks poisitioned above said top margin line and a second one of said page blocks positioned below said bottom margin line.

8. A typing guide as in claim 2 and wherein said back surface is vertically divided into two columns, said footnote samples being printed in one of said columns, and further comprising bibliography samples printed on the other of said columns, said bibliography samples being oriented in the same direction as said footnote samples.

9. A typing guide as in claim 8 and wherein said footnote samples comprise several different types of reference materials, and wherein said bibliography samples comprise the identical group of reference materials, whereby the identical reference work is printed in one column as a footnote sample and the other column as a bibliography sample.

10. A typing guide as in claim 1 and wherein said backing sheet is formed of a flexible material.

11. A method of typing footnotes using a typing guide formed of a single backing sheet having a front and back surface with a plurality of marks in vertical sequence extending from the lower edge and printed adjacent one side of the front surface, the marks being numerically identified by a progressively increasing sequence of numbers, commencing from the lower most mark, said method comprising the steps of:

(a) placing a sheet of typing paper over the front surface of the backing sheet with the marks exposed at one side of the typing paper;
(b) inserting the typing paper and underlying backing sheet into the typewriter;
(c) typing the desired text material on the typing paper sequentially identifying the footnote numbers included in the text of that page;
(d) terminating typing of the text material when reaching the mark having the same identifying number as the last footnote number typed; and
(e) typing the footnotes on the remainder of the page.

12. A method as in claim 11 and wherein the backing sheet comprises samples printed on the back surface in upside down manner with respect to the orientation of the front surface, said method further comprising the step of: bending the backing sheet forward when typing the footnotes to select the appropriate footnote sample.

13. A method of typing footnotes using a typing guide forming of a single backing sheet having front and back surfaces with a row of progressively increasing numerals printed adjacent one side of the front surface and commencing from proximate the top edge thereof, said method comprising the steps of:

(a) placing a sheet of typing paper over the front surface of the backing sheet with the numerals exposed at one side of the typing paper;
(b) inserting the typing paper and underlying backing sheet into the typewriter;
(c) typing the desired text material on the typing paper and estimating the total number of lines needed to type the footnotes corresponding to the footnote numbers included in the text of that page;
(d) adding two lines to said total number for separation from the text and additional line for separation between each of the footnotes,
(e) subtracting the total computed in the previous step from the last numeral in the column of numerals printed on the backing sheet;
(f) terminating typing of the text material when reaching the number corresponding to the number computed in the previous step; and
(g) typing the footnotes on the remainder of the page.

14. A method as in claim 13 and wherein the backing sheet comprises footnote samples printed on the back surface in upside down manner with respect to the orientation of the front surface, said method further comprising the step of: bending the backing sheet forward when typing the footnotes to select the appropriate footnote sample.

15. A method of forming a typing guide for typing text and footnotes onto a typing paper, comprising the steps of:

(a) selecting a flexible backing sheet wider than a typing paper;
(b) printing a footnote indicator on the front surface of the backing sheet adjacent one side edge thereof such that it will be exposed when underlying the typing paper; and
(c) printing footnote samples on the back surface upside down with respect to the orientation of the front surface, whereby as footnotes are being typed on the typing paper, the backing sheet can be bent forward with the footnote samples appearing in proper upright orientation.

16. A method as in claim 15 and wherein said step of printing footnote indicators further comprises the steps of:

(a) printing of column of numerals adjacent said one side edge of the front surface commencing from proximate the top thereof and increasing along the column, numerals being spaced apart from each other a distance equal to the line spacing of a typewriter platen;
(b) printing several marks in vertical sequence from the lower edge and adjacent a lower portion of said column of numerals, the marks corresponding to preselected numerals, and
(c) numerically identifying the marks by a progressively increasing sequence of the numbers commencing from the lower most mark.

17. A method as in claim 16 and further comprising the step of printing guide information on the front surface, said guide information comprising top, bottom, and side margin lines, a heading line, a vertical center line, and page number blocks, said guide information being visible through the overlying typing paper.

18. A method as in claim 16 and further comprising the step of vertically dividing the back surface into two columns, printing said footnote samples in one of said columns and printing bibliography samples in the other of said columns, said bibliography samples being printed in the same orientation as the footnote samples and wherein the identical reference work is printed in one column as a footnote sample and in the other column as a bibliography sample.

19. A method as in claim 18 and further comprising the step of printing a sample chapter page in one of said columns and a sample bibliography page on the other of said columns.

* * * * *